US006968576B2

(12) United States Patent
McNeil et al.

(10) Patent No.: US 6,968,576 B2
(45) Date of Patent: Nov. 29, 2005

(54) HELMET PROVIDING CERVICAL SPINE PROTECTION

(76) Inventors: Jay D. McNeil, 49 Parker Street, Truro, Nova Scotia (CA) B2N 3R2; Karen McNeil, 49 Parker Street, Truro, Nova Scotia (CA) B2N 3R2; John McNeil, 49 Parker Street, Truro, Nova Scotia (CA) B2N 3R2

( * ) Notice: Subject to any disclaimer, the term of this patent is extended or adjusted under 35 U.S.C. 154(b) by 33 days.

(21) Appl. No.: 10/799,752

(22) Filed: Mar. 15, 2004

(65) Prior Publication Data

US 2004/0194194 A1 Oct. 7, 2004

Related U.S. Application Data

(60) Provisional application No. 60/460,008, filed on Apr. 4, 2003.

(51) Int. Cl.[7] ..... A63B 71/10
(52) U.S. Cl. ..... 2/425; 2/462; 2/468
(58) Field of Search ..... 2/425, 422, 416, 2/468, 461, 462, 421; 602/16, 17, 18

(56) References Cited

U.S. PATENT DOCUMENTS

| | | | | |
|---|---|---|---|---|
| 2,807,260 A | | 9/1957 | Teufel | |
| 2,886,031 A | * | 5/1959 | Robbins | 602/19 |
| 3,134,106 A | | 5/1964 | Shaffer et al. | |
| 3,189,917 A | | 6/1965 | Sims | |
| 3,776,224 A | * | 12/1973 | McFarland | 602/18 |
| 3,818,509 A | | 6/1974 | Romo et al. | |
| 3,873,996 A | * | 4/1975 | Varteressian | 2/421 |
| 3,957,040 A | | 5/1976 | Calabrese | |
| 4,250,874 A | | 2/1981 | Rude | |
| 4,825,476 A | | 5/1989 | Andrews | |
| 5,003,968 A | | 4/1991 | Mars | |
| 5,123,408 A | | 6/1992 | Gaines | |
| 5,287,562 A | | 2/1994 | Rush, III | |
| 5,371,905 A | | 12/1994 | Keim | |
| 5,444,870 A | | 8/1995 | Pinsen | |
| 5,493,736 A | | 2/1996 | Allison | |
| 5,517,699 A | | 5/1996 | Abraham | |
| 5,581,816 A | | 12/1996 | Davis | |
| 5,715,541 A | | 2/1998 | Landau | |
| 5,930,843 A | | 8/1999 | Kelly | |
| 6,006,368 A | | 12/1999 | Phillips | |
| 6,210,354 B1 | * | 4/2001 | Ousdal | 602/36 |
| 6,560,789 B2 | | 5/2003 | Whalen et al. | |
| 2002/0043831 A1 | * | 4/2002 | Alsup | 297/216.12 |
| 2003/0088906 A1 | * | 5/2003 | Baker | 2/416 |

FOREIGN PATENT DOCUMENTS

| | | | | |
|---|---|---|---|---|
| EP | 850575 A1 | * | 7/1998 | A42B 3/04 |
| FR | 2700746 A1 | * | 7/1994 | B64D 10/00 |

* cited by examiner

*Primary Examiner*—Rodney M. Lindsey
(74) *Attorney, Agent, or Firm*—Mario Theriault

(57) ABSTRACT

A helmet has shock absorbing devices mounted to the sides thereof and extending to a pair of shoulder pads. The shock absorbing devices are connected by tubing to a pilot-operated valve, which allow a free movement of the helmet in a normal mode. An impact on the helmet, however, causes a rise in pressure inside the shock absorbing devices and their tubing, and activates the valve to block the flow of fluid through the tubing, thereby stiffening the shock absorbing devices and transmitting the impact force to the shoulders of the player.

20 Claims, 4 Drawing Sheets

HELMET PROVIDING CERVICAL SPINE PROTECTION

FIELD OF THE INVENTION

This invention pertains to sport helmets, and more particularly it pertains to sport helmets having configurations for protecting the cervical spines of users.

BACKGROUND OF THE INVENTION

Protective sport equipment has evolved over the past century, changing with the demands of the sport. Hockey, for example, is a contact sport that exposes players to serious risks, including potentially paralytic or fatal injuries to the cervical spine. Hockey equipment is designed to reduce or disperse impact forces, offering some level of protection to the player. Hockey helmets and face masks became mandatory in an effort to reduce head and facial trauma.

Unfortunately, no equipment exists to effectively protect the player's cervical spine. In fact, it is believed that the present headgear may be exposing players to increased risk of cervical spine injury by creating a false sense of protection, thereby leading to a more aggressive style of play. Hockey helmets are not designed to prevent cervical dislocation or fracture, which can both result in spinal cord injury and possible paralysis or death.

Research shows that the most common and dangerous cervical spine injuries are not caused by flexion or extension but are caused by axial loading of the spine. Axial loading occurs when the top of the head is hit and a direct longitudinal loading of the spine occurs. This usually results when a player is standing three to six feet from the boards and is shoved, sliding into the boards head first with the impact on the crown of the head. The force of this blow is transmitted directly down the spine and can result in compression fractures or burst fractures. If the vertebral body bursts or dislocates into the spinal cord, paralysis may occur.

The March 2000 edition of the Canadian Medical Association Journal reported on the incidence of hockey injuries to the spine in Canada from 1966 to 1996. The information was obtained through surveys to all neurosurgeons, orthopaedic surgeons, and physical medicine and rehabilitation specialists in Canada. In recent years, statistics from sport medicine physicians were also added to the samples as well as information from player insurance reports at the Canadian Hockey Association.

In Canada, 243 spinal injuries were reported between 1966 and 1996. Six players are known to have died from their injuries. Adequate documentation was available to assess the level of injuries for 89% of these cases, 85% being at the cervical spine level. Impact with the boards accounted for 77% of the injuries and 40% were the result of a push or check from behind. Burst fractures and fracture-dislocations were the most frequent injuries recorded. The injured players ranged from 11 to 47 years of age, the mean age being 17 years. Fifty percent of spinal cord injuries occurred in the 16–20 year age group and most occurred during competitive play.

Several attempts have been made in the past to design sport helmets incorporating cervical spine protection. Unfortunately, these prior art helmets did not enjoy a lasting success. In that regard, the following documents represent a good inventory of the protection systems preceding the present invention.

U.S. Pat. No. 3,134,106 issued to Archie Shaffer et al. on May 26, 1964, discloses protective equipment for a football player, wherein the helmet is supported to the shoulder pads by means a two vertical stiff blades that are formed integrally with the shoulder pads. The stiff blades are adjustably fastened to the sides of the helmet.

U.S. Pat. No. 3,189,917 issued to Danton F. Sims on Jun. 22, 1965, discloses a combination of a helmet and a protective collar. The collar is contoured so as to fit comfortably on the shoulders of the wearer and has an upper edge portion extending around the neck in substantially uniform spaced relationship with the bottom edge of the helmet. The helmet's bottom edge and the neck collar's upper edge portion are movable into mutual engagement by an elevation of the wearer's shoulders or a movement of the helmet or by the combination of both the collar and the helmet movements, whereby a force applied to the helmet from virtually any direction is transmitted to the collar and from the collar to the player's shoulders without subjecting the neck to excessive strains or impact which could result in injury.

U.S. Pat. No. 4,825,476 issued to Donald L. Andrews on May 2, 1989, discloses a head, neck and shoulder protection device. The shoulder pad assembly has an annular track thereon in which the helmet is mounted. The helmet is movable along the track and can tilt forward and backward about a pivot axis through a pair of projections on the annular track.

U.S. Pat. No. 5,123,408 issued to Leonard F. Gaines on Jun. 23, 1992, discloses a helmet and a back brace for protection of the cervical spine. The brace extends along the spine of the player and around the back and the top portion of the helmet. The brace is movably held to the helmet under two support bands affixed to the helmet. On its lower end, the brace is supported on two shoulder straps. The helmet loads are transferred to the shoulders of the player directly, thus transferring excessive head loads onto the chest area of the player where they can be more safely absorbed.

U.S. Pat. No. 5,287,562 issued to Gus A. Rush, III on Feb. 22, 1994, discloses a helmet having an inflatable bag attached to its lower edge. A switch located on the crown of the helmet activate a battery-operated gas generator to inflate the bag and protect the wearer against neck injuries. In another version, the rim of the helmet extends downward upon impact. The rim is actuated by three gas-operated pistons.

Similar sport helmets having props, braces, padding and shock absorbers mounted thereto are described and illustrated in the following documents:

U.S. Pat. No. 5,371,905 issued to Hugo A. Keim on Dec. 13, 1994.

U.S. Pat. No. 5,444,870 issued to David Pinsen on Aug. 29, 1995.

U.S. Pat. No. 5,493,736 issued to Norman E. Allison on Feb. 27, 1996.

U.S. Pat. No. 5,517,699 issued to G. E. Abraham, II on May 21, 1996.

U.S. Pat. No. 5,581,816 issued to Emsley A. Davis on Dec. 10, 1996.

U.S. Pat. No. 5,715,541 issued to William M. Landau on Feb. 10, 1998.

U.S. Pat. No. 5,930,843 issued to James M. Kelly on Aug. 3, 1999.

U.S. Pat. No. 6,006,368 issued to Richard L. Phillips on Dec. 28, 1999.

In another aspect of cervical spine protection systems in sport helmets, the U.S. Pat. No. 6,560,789 issued to T. Whalen et al. on May 13, 2003, discloses a load absorbing pad that can be mounted inside a helmet to absorb impact forces on the helmet. The load absorbing pad has resilient bags containing a fluid under pressure connected to one or more expandable reservoirs made of elastomeric material connected to the resilient bags. A load applied to the bags forces the fluid from the bag to the reservoir where the energy is dissipated. After the load is removed from the resilient bag, the reservoir returns to its original shape to return the fluid to the resilient bags.

Although the devices and systems of the prior art deserve undeniable merits, it is believed that the additional protection afforded by these devices and systems was obtained in exchange for some reduction in comfort and mobility of the player. It is believed that for that reason, basically, sport helmets incorporating cervical spine protection did not appeal to a majority of players and therefore are still not available commercially. Therefore, it is also believed that a market demand still exists for sport helmets capable of providing cervical spine protection while having minimal effect on the player's agility and skills.

SUMMARY OF THE INVENTION

In the present invention, however, there is provided a helmet having shock absorbing devices mounted to the sides thereof and extending to the shoulder pads. The shock absorbing devices are connected by tubing to a pilot-operated valve, which allow a free movement of the helmet in a normal mode. An impact on the helmet, however, causes a rise in pressure inside the shock absorbing devices and their tubing, and activates the valve to block the flow between the shock absorbing devices, thereby stiffening the shock absorbing devices and transmitting the impact force to the shoulders of the player.

In a broad aspect of the present invention, there is provided a sport equipment for protection of the cervical spine of a user, comprising a helmet, a pair of shoulder pads, a pair of hydraulic cylinders affixed to the helmet and to the shoulder pads, and a valve mounted between the shoulder pads. The valve is connected to the cylinders by tubing. The valve is a pilot-operated valve having a threshold pressure of operation. The valve, tubing and cylinders are connected together to allow an unrestricted movement of the cylinders and of the helmet when a pressure inside the tubing is less than the threshold pressure, and to block all flow of fluid to and from the cylinders when a pressure in the tubing is above the threshold pressure.

This arrangement provides a compact and effective protection system that does not prevent the player from moving his/her head in a normal manner during normal play. It is believed that this system provides a substantial degree of protection without adversely affecting the skills and freedom of movement of the player wearing it.

In another aspect of the present invention, the cylinders, the valve and tubing form a closed hydraulic circuit, which is preferably filed with vegetable oil. Because of the closed circuit arrangement, the amount of hydraulic fluid in the system is kept small. The entire protection system can be kept light in weight such that its use has a minimal effect on the fatigue of the player. The vegetable oil is preferred because it is environmentally friendly.

In another aspect of the present invention, the cylinders are mounted to the helmet and to the shoulder pads by means of ball and socket joints having detachable engagement means. The cylinders are thereby easily attached to or detached from the helmet or from the shoulder pads during the dressing and undressing of the player.

In yet a further aspect of the present invention, there is provided a sport equipment for protection of the cervical spine of a user, comprising a helmet, a pair of shoulder pads, a pair of air bags affixed to the helmet and to the shoulder pads, a valve mounted between the shoulder pads, and tubing joining the air bags to the valve. The valve is a pilot-operated valve having a threshold pressure of operation, and is connected to the tubing to allow an unrestricted flow of air from one of the air bags to the other when a pressure in the tubing is less than the threshold pressure, and to block all flow of air to and from the air bags when a pressure in the tubing is above the threshold pressure.

As can be appreciated, the shock absorbing devices usable in the protective sport equipment according to the present invention are not limited to hydraulic devices, but also comprise pneumatic equipment. This latter aspect of the present invention has been introduced herein to illustrate the fact that the variations in the applicability of the concept of the present invention are only limited by the imagination of the manufacturer.

This brief summary has been provided so that the nature of the invention may be understood quickly. A more complete understanding of the invention can be obtained by reference to the following detailed description of the preferred embodiments thereof in connection with the attached drawings.

BRIEF DESCRIPTION OF THE DRAWINGS

Two embodiments of the present invention are illustrated in the accompanying drawings, in which like numerals denote like parts throughout the several views, and in which.

DESCRIPTION OF THE PREFERRED EMBODIMENTS

Figure 1:
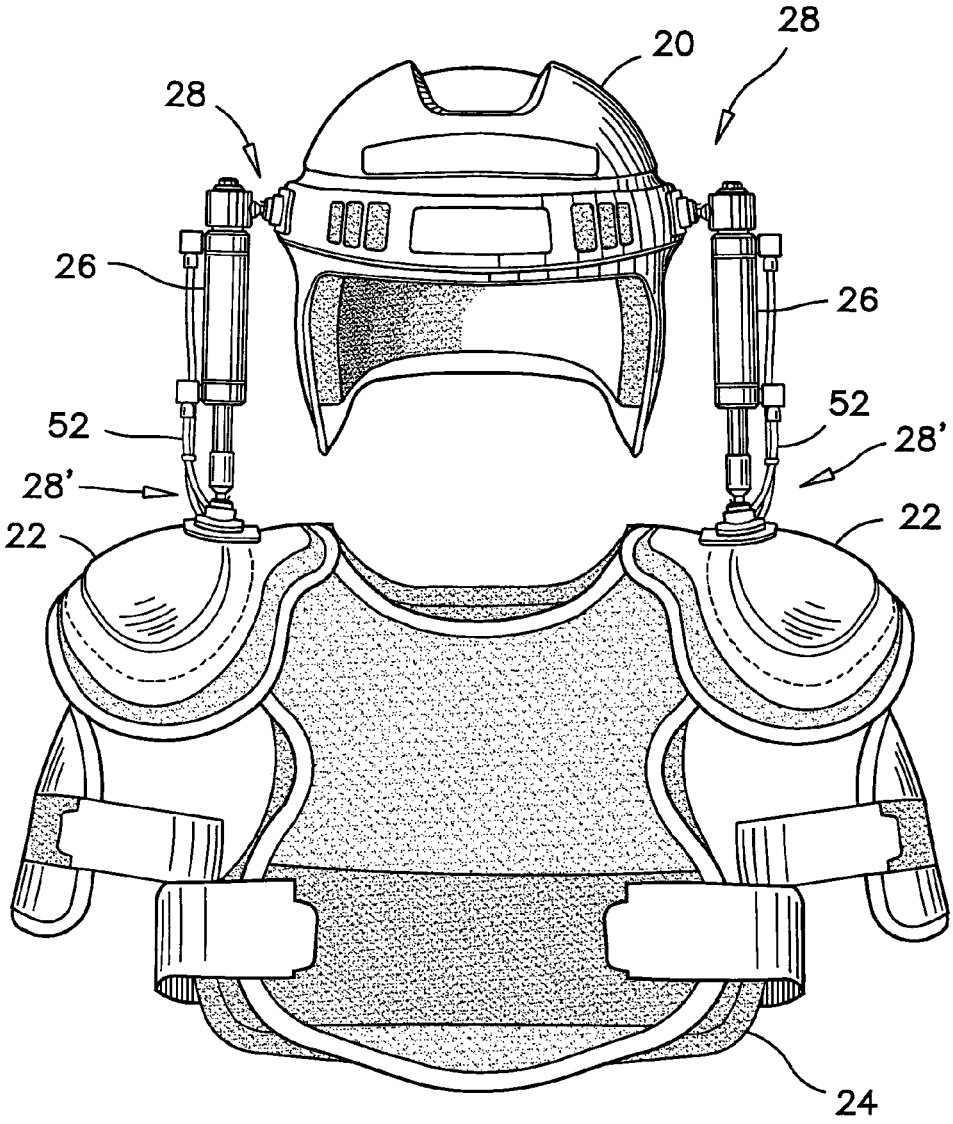
FIG. 1 is a front view of the protective sport equipment according to the first preferred embodiment of the present invention.

While this invention is susceptible of embodiment in many different forms, there are shown in the drawings and will be described in details herein two specific embodiments, with the understanding that the present disclosure is to be considered as an example of the principles of the invention and is not intended to limit the invention to the embodiments illustrated and described.

Figure 2:
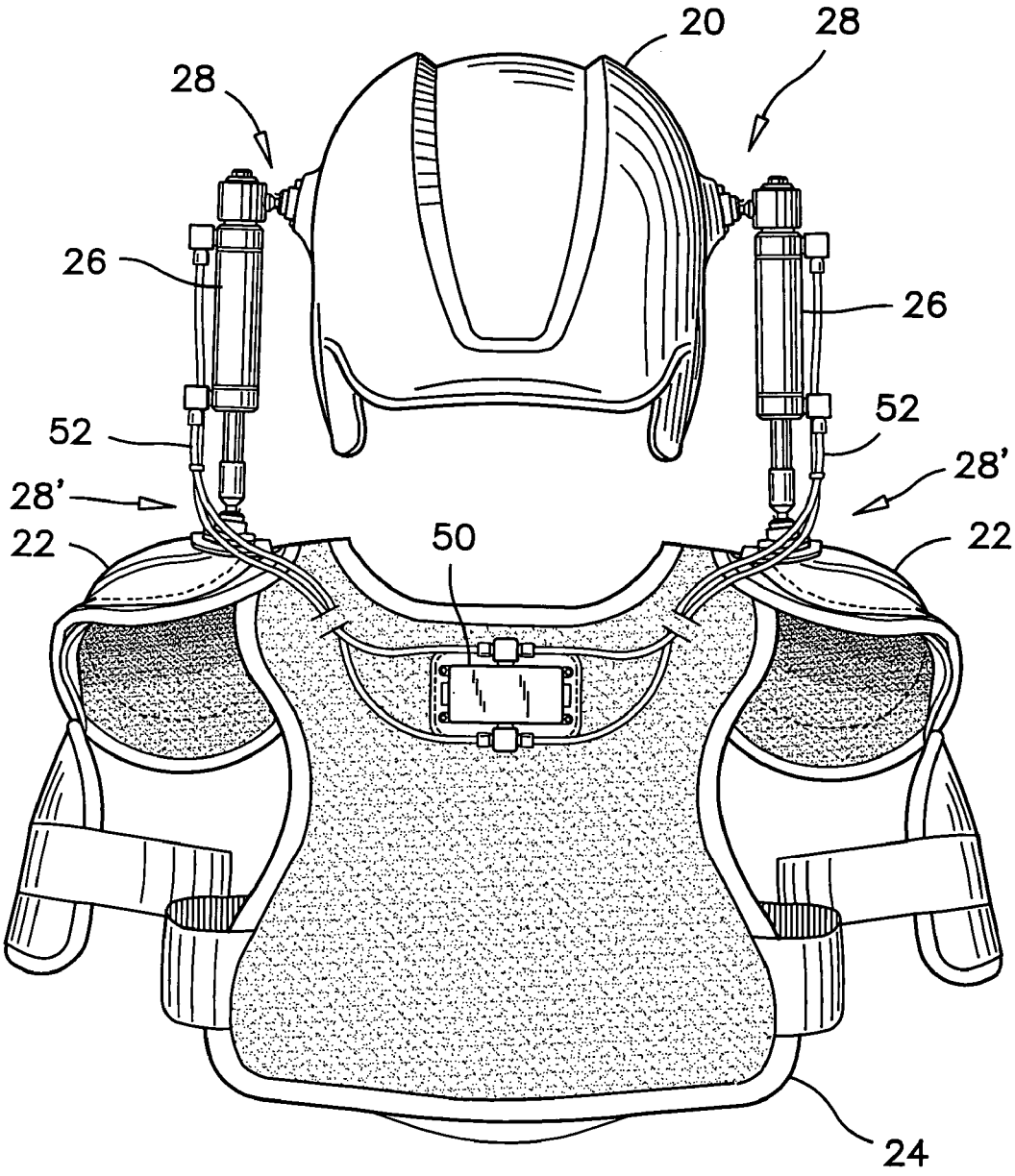
FIG. 2 is a rear view of the protective sport equipment according to the first preferred embodiment.
Figure 3:
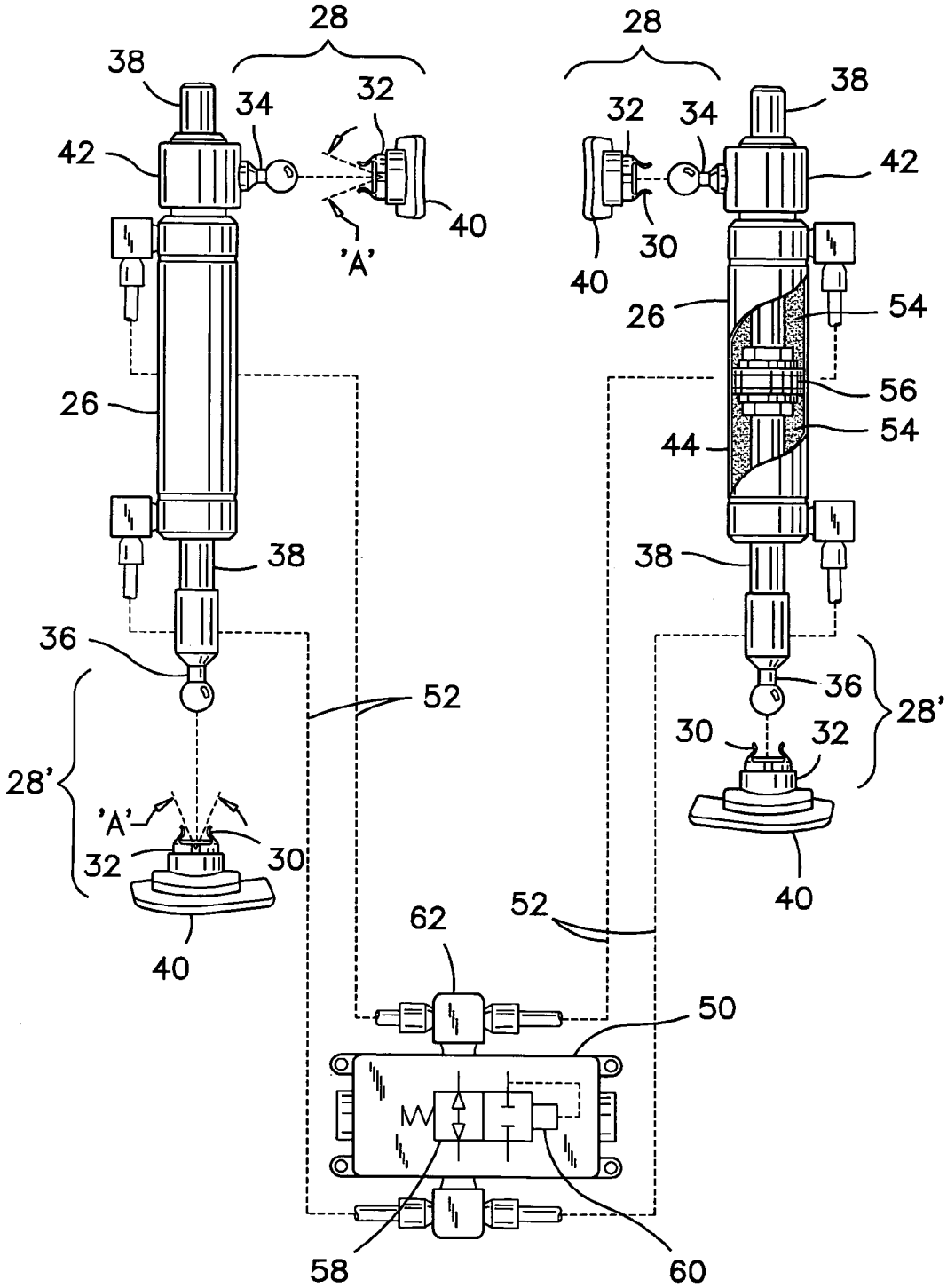
FIG. 3 is a schematic illustration of the fluid circuit of the protective sport equipment according to the first preferred embodiment.

Referring firstly to FIGS. 1, 2 and 3 simultaneously, the protective sport equipment according to the first preferred embodiment will be described. The protective sport equipment comprises a helmet 20 and a set of shoulder pads 22 mounted to a protective vest 24. A pair of hydraulic cylinders 26 extend between the helmet 20 and the shoulder pads 22. The shoulder pads 22 are retained to the protective vest 24 as it is customary with hockey equipment.

The hydraulic cylinders 26 are affixed to the helmet 20 and to the shoulder pads 22 by means of ball and socket joints 28, 28' each having a detachable engagement comprising a retaining clip 30, and a sway limiting socket 32 to limit the stems' movements from their respective axes. A limited sway angle 'A' of 30° is common and available in those ball and socket joints 28, 28'. However, this angle remains the choice of the manufacturer and may be different for different helmet sizes. In all applications, however, the sway angle should be selected to prevent an axial load on the helmet from being converted to a combined axial and torsional load.

The retaining clip 30 on each socket 32 is advantageous for allowing the separation of the ball and socket joints 28, 28' by the force of the hand, to facilitate the dressing and undressing of the player.

The ball and socket joints 28 connecting the hydraulic cylinders 26 to the helmet 20 have radial stems 34 extending perpendicularly from the sides of the cylinders 26, and the ball and socket joints 28' connecting the hydraulic cylinders 26 to the shoulder pads have axial stems 36 extending from the ends of the cylinder rods 38.

The socket portions 32 of the ball and socket joints 28, 28' are mounted on pads 40 that are affixed by adhesive for example, to the side of the helmet 20 or to the top surface of the shoulder pads 22. Each stem 34 of the upper ball and socket joints 28 is affixed to an annular member 42 which is rigidly mounted to the casing 44 of each cylinder 26, while the lower ball and socket joint 28' moves with the cylinder rod 38.

Ball and socket joints 28, 28' of the type described above are referred to as quick disconnecting ball joint assemblies and are available from the Superior Linkage Division of Tuthill Corporation of New Haven, Ind., USA, 46774.

Both hydraulic cylinders 26 are in fluid communication with a valve 50 by means of flexile tubing 52. The valve 50 is preferably mounted to the back of the protective vest 26 between the shoulder pads 22, as illustrated in FIG. 2. The preferred fluid used in the hydraulic circuit is a vegetable oil which is easily cleaned and environmentally friendly. As can be appreciated, the cylinders, the tubing and the valve form a closed circuit. This circuit has fill openings and/or bleed valves which are not illustrated on the drawings for not being the focus of the present invention.

The hydraulic cylinders 26 are of the double-rod-end type whereby they have a same fluid volume 54 per unit of length on both sides of the piston 56. During normal movements, the fluid in one side of the piston 56 can move to the other side 54 in a same cylinder 26, or to either sides of the other cylinder 26.

Referring now specifically to FIG. 3, the valve 50 is a two-position, spring-return, normally-open, pilot-operated valve, and its operation is as illustrated in the diagram 58 shown on the valve body. In the normal mode, the fluid volumes 54 on both sides of the pistons 56 are in communication with each other through the tubing 52 and through the ports of the valve 50, whereby the pistons 56 can move freely inside the cylinder casings 44. This free movement of the pistons 56 and of the rods 38 relative to the casings 44 allows a free movement of the helmet 20 relative to the shoulder pads 22.

Both cylinders 26 are connected in parallel to the valve's ports, such that one cylinder 26 can move independently of the other, or they can both move in a same direction or in opposite directions at the same time. The radial stems 34 allow for a horizontal rotation of the helmet and the vertical stems 36 on the cylinder rods 38 allow for a forward and rear motion of the helmet. Therefore, the presence of the cylinders 26 along the helmet, in the normal mode, does not hinder the free movement of the helmet, forward, backward, from side to side and about a vertical axis.

The perpendicular orientation of the upper stems 34 in combination with the retaining clips 30 are convenient for dismounting the cylinders 26 from the helmet 20 by pulling the cylinders 26 away from the helmet 20. Similarly, the longitudinal stems 36 are convenient for pulling the cylinders 26 away from the shoulder pads 22. The detachable aspect of the ball and socket joints 28, 28' also constitutes a safety feature to allow the immediate release of a cylinder 26 from the helmet 20 should it becomes entangled with a hockey stick for example.

The pilot-operated valve 50 is selected to operate on a pilot pressure of a few pounds per square inch. A threshold pressure of 8 psi is recommended for causing an operation of the pilot-operated actuator 60. The pilot-operated actuator 60 is connected to the load supporting side 62 of the cylinders 26. Immediately upon sensing an increase in pressure above the threshold pressure inside one of the cylinders 26, the actuator 60 moves the valve's spindle (not shown) to the port-blocked mode, thereby stopping the linear motion of the cylinders 26, and transferring any axial load on the helmet 20 to the shoulder pads 22. When the pressure is released, however, the valve spool returns to its open position, thereby resuming a free movement of the helmet 20.

Figure 4:
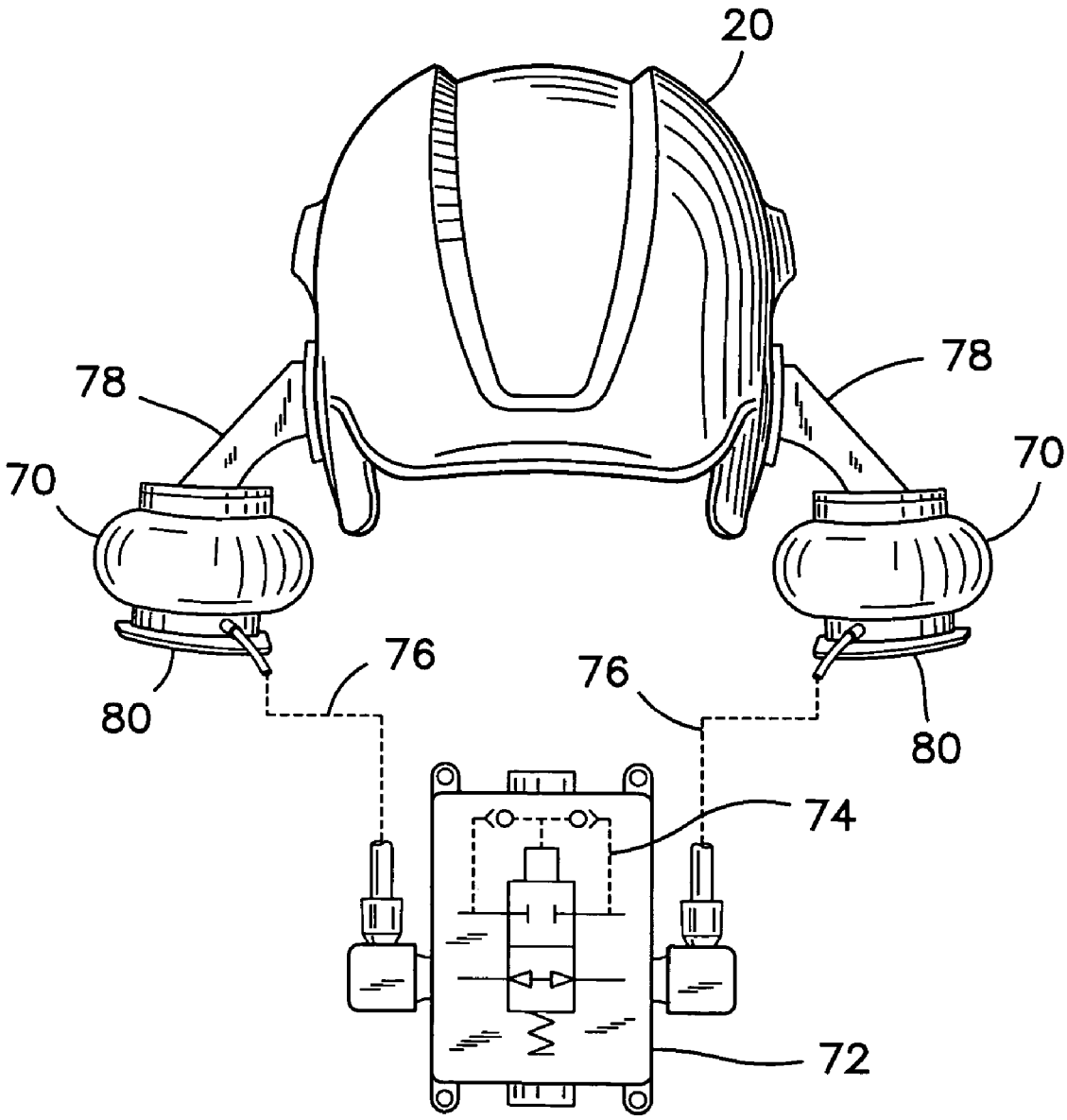
FIG. 4 is rear view of the protective sport equipment according to the second preferred embodiment of the present invention, and a schematic illustration of the fluid circuit thereof.

Referring now to FIG. 4, the protective sport equipment according to the second preferred embodiment is illustrated therein. In this second preferred embodiment, the hydraulic cylinders have been replaced by air bags 70. The two-position, spring-return, normally-open, pilot-operated valve 72 has a pressure sensing circuit 74 connected to both segments of tubing 76 between the valve 72 and the air bags 70.

The top portion of each air bag 70 has a rigid brace 78 extending to one side of the helmet 20. The lower portion of each air bag 70 has a curved pad 80 that is mountable to a respective shoulder pad (not shown) in a similar manner as in the first preferred embodiment. The valve 72 is also mountable to the protective vest (not shown) of a sport equipment in a same manner as previously illustrated.

In use, the air from one air bag 70 is free to flow though the valve 72 and tubing 76 to the other air bag 70 for allowing an unrestricted side-to-side and forward and back movements of the helmet 20 relative to the shoulder pads. When the pressure increases in one of the air bags 70, or in the tubing 76, however, such as during a fall of the player or other impact force on the helmet, the valve 74 closes thereby preventing any flow of air there through. Any loading or impact force on the helmet is thereby absorbed by the shoulder pads of the player. It will be appreciated that the preferred threshold pressure of the pilot-operated valve 72 in this second embodiment is much lower than 8 psi and is proportionally smaller in a same relation as the ratio of the cross-section area of one of the cylinders 26 over the horizontal cross-section area of one of the air bags 70.

As to other manner of usage and operation of the present invention, the same should be apparent from the above description and accompanying drawings, and accordingly further discussion relative to the manner of usage and operation of the invention would be considered repetitious and is not provided.

While two embodiments of the present invention have been illustrated and described herein above, it will be appreciated by those skilled in the art that various modifications, alternate constructions and equivalents may be employed without departing from the true spirit and scope of the invention. Therefore, the above description and the illustrations should not be construed as limiting the scope of the invention which is defined by the appended claims.

We claim:

1. A sport equipment for protection of the cervical spine of a user, comprising;

a helmet;

a pair of shoulder pads;

a pair of cylinders affixed to said helmet and to said shoulder pads, a valve mounted between said shoulder pads, and tubing joining said cylinders to said valve;

said valve being a pilot-operated valve having a threshold pressure of operation and means to allow an unrestricted flow inside said tubing when a pressure in said tubing is less than said threshold pressure, and means to block said flow when a pressure in said tubing is above said threshold pressure.

2. The sport equipment as claimed in claim 1, further comprising a sport vest, and said valve is mounted to a back portion of said vest.

3. The sport equipment as claimed in claim 1, wherein said cylinders are mounted to said helmet by means of ball and socket joints.

4. The sport equipment as claimed in claim 3, wherein each of said ball and socket joints has a detachable engagement comprising a retaining clip.

5. The sport equipment as claimed in claim 3, wherein each of said ball and socket joints has a limited sway angle.

6. The sport equipment as claimed in claim 1, wherein said cylinders are mounted to said shoulder pads by means of ball and socket joints.

7. The sport equipment as claimed in claim 1, wherein each of said cylinders is a double-rod-end cylinder.

8. The sport equipment as claimed in claim 7, wherein each of said cylinders is held to said helmet by means of a first ball and socket joint having a stem extending perpendicularly from a casing thereof, and is held to one of said shoulder pads by means of a second ball and socket joint having a stem extending longitudinally from a rod end thereof.

9. The sport equipment as claimed in claim 8, wherein each of each of said first and second ball and socket joints has a detachable engagement comprising a retaining clip.

10. The sport equipment as claimed in claim 8 wherein each of said first and second ball and socket joints has a limited sway angle.

11. The sport equipment as claimed in claim 1 wherein said threshold pressure of operation is 8 psi.

12. The sport equipment as claimed in claim 1, wherein said cylinders, said tubing and said valve form a closed circuit.

13. The sport equipment as claimed in claim 12, wherein said closed circuit contains vegetable oil.

14. The sport equipment as claimed in claim 1, wherein said valve is a two-position, spring-return, normally-open, pilot-operated valve.

15. A sport equipment for protection of the cervical spine of a user, comprising;

a helmet;

a pair of shoulder pads;

a pair of double-rod-end cylinders affixed to said helmet and to said shoulder pads, a valve mounted between said shoulder pads, and tubing joining said cylinders to said valve;

each of said cylinders is held to said helmet by means of a first ball and socket joint having a stem extending perpendicularly from a casing thereof, and is held to one of said shoulder pads by means of a second ball and socket joint having a stem extending longitudinally from a rod end thereof, said valve being a pilot-operated valve having a threshold pressure of operation of about 8 psi, said valve further having means to allow an unrestricted movement of said cylinders when a pressure in said tubing is less than said threshold pressure, and means to block all flow of fluid to and from said cylinders when a pressure in said tubing is above said threshold pressure.

16. The sport equipment as claimed in claim 15, wherein each of said first and second ball and socket joints has a detachable engagement comprising a retaining clip.

17. The sport equipment as claimed in claim 16, wherein each of said first and second ball and socket joints has a limited sway angle.

18. The sport equipment as claimed in claim 15, further comprising a sport vest, and said valve is mounted to a back portion of said vest.

19. A sport equipment for protection of the cervical spine, comprising;

a helmet;

a pair of shoulder pads;

a pair of air bags affixed to said helmet and to said shoulder pads, a valve mounted between said shoulder pads, and tubing joining said air bags to said valve;

said valve being a pilot-operated valve having a threshold pressure of operation, said valve further having means to allow an unrestricted flow of air from one of said air bags to the other when a pressure in said tubing is less than said threshold pressure, and means to block all flow of air to and from said air bags when a pressure in said tubing is above said threshold pressure.

20. The sport equipment as claimed in claim 19 wherein each of said air bags is connected to said helmet by means of a stiff brace, and each of said air bags has a curved pad on the lower side thereof for attachment to a shoulder pad of a hockey equipment.

* * * * *